US007479475B2

(12) United States Patent
de Buzzaccarini et al.

(10) Patent No.: US 7,479,475 B2
(45) **Date of Patent: *Jan. 20, 2009**

(54) SINGLE COMPARTMENT UNIT DOSE FABRIC TREATMENT PRODUCT COMPRISING POUCHED COMPOSITIONS WITH NON-CATIONIC FABRIC SOFTENER ACTIVES

(75) Inventors: Francesco de Buzzaccarini, Breedonk (BE); Jan Julien Marie-Louise Billiauw, Gentbrugge (BE); Karel Jozef Maria Depoot, Anzegem-Vichte (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/742,555

(22) Filed: Dec. 19, 2003

(65) Prior Publication Data

US 2004/0142841 A1 Jul. 22, 2004

(30) Foreign Application Priority Data

Dec. 19, 2002 (EP) ..... 02447259
Oct. 15, 2003 (EP) ..... 03447252

(51) Int. Cl.
*C11D 17/00* (2006.01)

(52) U.S. Cl. ..... 510/293; 510/295; 510/296; 510/297; 510/407; 510/439; 510/466

(58) Field of Classification Search ..... 510/295, 510/297, 298, 439, 424, 421, 505, 515, 507
See application file for complete search history.

(56) References Cited

U.S. PATENT DOCUMENTS 5,004,556 A 4/1991 Julemont et al.
5,670,677 A 9/1997 Ponsati et al.
6,492,315 B1 12/2002 Cao et al.
6,750,187 B2 * 6/2004 Alam et al. ..... 510/221
6,815,410 B2 * 11/2004 Boutique et al. ..... 510/295
2002/0077264 A1 6/2002 Somerville-Roberts et al.

FOREIGN PATENT DOCUMENTS

| | | | |
|---|---|---|---|
| EP | 0 422 787 | A2 | 4/1991 |
| EP | 339 707 | B2 | 4/1998 |
| GB | 2355269 | * | 4/2001 |
| GB | 2365018 | * | 2/2002 |
| WO | WO01/81520 | A1 | 11/2001 |
| WO | WO01/85888 | A3 | 11/2001 |
| WO | WO02/08380 | | 1/2002 |
| WO | WO 02/12432 | * | 2/2002 |
| WO | WO 02/094975 | * | 11/2002 |

* cited by examiner

*Primary Examiner*—Necholus Ogden, Jr.
(74) *Attorney, Agent, or Firm*—Ronald T. Sia; Armina E. Matthews; David V. Upite

(57) ABSTRACT

The present invention relates a unit dose fabric treatment product comprising a non-aqueous liquid fabric treatment composition contained in a single compartment water-soluble pouch. The inner space of said pouch comprises (A) a cleaning system comprising more than 5% by weight of the fabric treatment composition of at least one anionic surfactant; and (B) a fabric softening system comprising at least one non-cationic fabric softening active selected from the group consisting of fabric softening clays, fabric softening silicones, and mixtures thereof, wherein the fabric softening clay is added as a premix comprising the clay and a solvent; wherein the fabric softening silicone is added as a premix comprising the silicone and a solvent or wherein the fabric softening silicone is added as pure compound without any solvent.

The invention further relates to a method of producing such compositions and to the use of such compositions to impart fabric-cleaning and fabric-softening benefits via single compartment water-soluble pouches to fabrics treated therewith.

24 Claims, No Drawings

SINGLE COMPARTMENT UNIT DOSE FABRIC TREATMENT PRODUCT COMPRISING POUCHED COMPOSITIONS WITH NON-CATIONIC FABRIC SOFTENER ACTIVES

FIELD OF THE INVENTION

This invention relates to unit dose products which deliver liquid fabric treatment compositions. In particular, this invention relates to single compartment, pouched, non-aqueous compositions providing fabric cleaning and fabric softening benefits delivered through an easy to handle unit dose system.

BACKGROUND TO THE INVENTION

Fabric cleaning/softening products come in a number of forms, such as granules, liquids, tablets, and pouches. Each form has its own advantages and disadvantages.

Recently, water-soluble pouches containing fabric cleaning or softening actives have become popular. In general, the pouches comprise a non-aqueous liquid composition surrounded by a water-soluble film, such as a polyvinyl alcohol film. These products have the advantage that they are convenient to dose, easy to handle and cause little mess in comparison with traditional composition forms. EP 339 707 (Unilever) discloses a non-aqueous detergent composition contained in a PVA film. WO 01/81 520 (Colgate) discloses a wash-cycle single compartment unit dose softener composition.

However, none of these two executions provide both cleaning and softening benefits at the same time. WO 01/85 888 discloses a unit-dose composition delivering fabric softening benefits and comprising up to 5% wt. or less of surfactants. The disadvantage of this system is the low cleaning performance due to the low surfactant content.

The prior art also provides unit dose systems, which provide fabric cleaning and fabric softening benefits at the same time. However, due to compatibility problems of the cleaning system comprising an anionic surfactant, and of the fabric softening system, comprising a cationic fabric softening active, the execution of WO 02/08 380 (P&G) involves dual compartment pouches, in which the first compartment contains a detergent composition and in which the second compartment contains a fabric softening composition.

It is well known in the art that dual compartment unit dose systems are not easy to manufacture, and especially not in an economical way. It is therefore an object of the present invention to provide single compartment unit dose non-aqueous liquid fabric treatment compositions that impart superior performance, in terms of cleaning and fabric softening benefits.

In order to achieve this objective, it is necessary to overcome the incompatibility problem of anionic surfactants and fabric softening actives, especially when the fabric softening active is a cationic fabric softening active. The present invention provides a solution of this problem by utilizing non-cationic fabric softening actives which can be combined with anionic surfactants and do not cause incompatibility problems.

Another problem associated with the incorporation of cationic fabric softeners into water-soluble films is the interaction of the cationic softener with the typically negatively charged surface of polyvinyl-alcohol containing films. This difficulty has also been overcome by utilizing non-cationic fabric softening actives which can be combined with negatively charged film surfaces and do not cause incompatibility problems.

Furthermore, prior art unit dose products have shortcomings with respect to dissolving quickly and completely upon contact with water. Hence, it is another object of the present invention to provide pouched compositions which are able to disintegrate quickly and completely without excessive residue being left in the drawer, in the wash drum, or on laundered clothing.

It has now surprisingly been found that the pouched compositions of the present invention demonstrate very good cleaning performance and very good fabric softening, especially fabric softening performance. Additionally, it has been found that the pouched compositions of the present invention demonstrate better solubility and/or lower residues formation.

SUMMARY OF THE INVENTION

The present invention relates to unit dose products in form of liquid fabric treatment compositions contained in single compartment water-soluble pouches. The inner space of each pouch comprises (A) a cleaning system comprising more than 5% by weight of the fabric treatment composition of at least one anionic surfactant; and (B) a fabric softening system comprising at least one non-cationic fabric softening active selected from the group consisting of fabric softening clays, fabric softening silicones, and mixtures thereof.

wherein the fabric softening clay is added as a premix comprising the clay and a solvent; wherein the fabric softening silicone is added as a premix comprising the silicone and a solvent or wherein the fabric softening silicone is added as pure compound without any solvent.

The water-soluble pouches are typically in direct contact with the compositions.

A method of producing unit dose products according to the present invention and the use of unit dose products according to the present invention to treat fabrics and to thereby impart fabric-cleaning and fabric-softening benefits via single compartment water-soluble pouches are also subjects of the present invention. The method of producing the unit dose products herein involves separate preparation of the fabric cleaning system and of the fabric softening system, and thereinafter combining the two systems.

DETAILED DESCRIPTION OF THE INVENTION

The pouch herein is typically a closed structure, made of materials described herein, enclosing a volume space. The pouch contains a fabric treatment composition, which can be in any suitable form, provided the composition is at least partly liquid. The composition must comprise a fabric cleaning system and a fabric softening system. These elements will be described in more detail below.

The pouch and volume space thereof, can be of any form, shape and material which is suitable to hold the composition, e.g. without allowing the release of the composition from the pouch prior to contact of the pouch with water during laundering. The exact execution will depend on, for example, the type and amount of the composition in the pouch, the characteristics required from the pouch to hold, protect and deliver or release the compositions, provided that the pouch is a single compartment water-soluble pouch. Preferably, the pouch has a spheroid shape.

The pouch may be of such a size that it conveniently contains either a unit dose amount of the composition herein, suitable for the required operation, for example one wash, or only a partial dose, to allow the consumer greater flexibility to vary the amount used, for example depending on the size and/or degree of soiling of the wash load.

1, Single Compartment Water-Soluble Pouch

The pouch is typically made from a water-soluble film. Preferred water-soluble films are polymeric materials, preferably polymers which are formed into a film. The material in the form of a film can for example be obtained by casting, blow-moulding, extrusion or blow extrusion of the polymer material, as known in the art.

The water-soluble films for use herein typically have a solubility of at least 50%, preferably at least 75% or even at least 95%, as measured by the method set out hereinafter using a glass-filter with a maximum pore size of 50 microns, namely:

Gravimetric method for determining water-solubility of the material of the compartment and/or pouch:

50 g±0.1 g of material is added in a 400 ml beaker, whereof the weight has been determined, and 245 ml±1 ml of distilled water is added. This is stirred vigorously on magnetic stirrer set at 600 rpm, for 30 minutes. Then, the mixture is filtered through a folded qualitative sintered-glass filter with the pore sizes as defined above (max. 50 μm). The water is dried off from the collected filtrate by any conventional method, and the weight of the remaining polymer is determined (which is the dissolved or dispersed fraction). Then, the percentage solubility or dispersability can be calculated.

It may be preferred that the water-soluble film and preferably the pouch as a whole is stretched during formation and/or closing of the pouch, such that the resulting pouch is at least partially stretched. This is to reduce the amount of film required to enclose the volume space of the pouch. When the film is stretched the film thickness decreases. The degree of stretching indicates the amount of stretching of the film by the reduction in the thickness of the film. For example, if by stretching the film, the thickness of the film is exactly halved then the stretch degree of the stretched film is 100%. Also, if the film is stretched so that the film thickness of the stretched film is exactly a quarter of the thickness of the unstretched film then the stretch degree is exactly 200%. Typically and preferably, the thickness and hence the degree of stretching is non-uniform over the pouch, due to the formation and closing process.

Another advantage of stretching the pouch, is that the stretching action, when forming the shape of the pouch and/or when closing the pouch, stretches the pouch non-uniformly, which results in a pouch which has a non-uniform thickness. This allows control of the dissolution of water-soluble pouches herein.

Preferably, the pouch is stretched such that the thickness variation in the pouch formed of the stretched water-soluble film is from 10 to 1000%, preferably 20% to 600%, or even 40% to 500% or even 60% to 400%. This can be measured by any method, for example by use of an appropriate micrometer. Preferably the pouch is made from a water-soluble film that is stretched, and wherein the film has a stretch degree of from 40% to 500%, preferably from 40% to 200%.

The film preferably has a thickness of from 1 μm to 200 μm, more preferably from 15 μm to 150 μm, even more preferably from 30 μm to 100 μm.

Preferably, the fabric treatment composition is a composition to be delivered to water and thus, the pouch and the compartment thereof are designed such that its contents are released at, or very shortly after, the time of placing the pouch in water. Thus it is preferred that the pouch with is compartment is formed from a material which is water-soluble. In one preferred embodiment, the component is delivered to the water within 3 minute, preferably even within 2 minutes or even within 1 minute after contacting the pouched composition with water.

In general, the pouch can be made from any material suitable for use in conventional unit dose laundry products. However, it has been found that certain polymer and/or copolymers and/or derivatives thereof are preferred. Preferred polymer and/or copolymers and/or derivatives thereof are selected from polyvinyl alcohol (PVA), polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum; and mixtures thereof. More preferably the polymer is selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and mixtures thereof, most preferably polyvinyl alcohols, polyvinyl alcohol copolymers, hydroxypropyl methyl cellulose (HPMC), and mixtures thereof. Preferably, the level of polymer in the film, for example a PVA polymer, is at least 60%.

The polymer can have any weight average molecular weight, preferably from 1000 to 1,000,000, or even from 10,000 to 300,000 or even from 15,000 to 200,000 or even from 20,000 to 150,000.

Mixtures of polymers can also be used. This may in particular be beneficial to control the mechanical and/or dissolution properties of the compartment or pouch, depending on the application thereof and the required needs. For example, it may be preferred that a mixture of polymers is present in the material of the pouch compartment, whereby one polymer material has a higher water-solubility than another polymer material, and/or one polymer material has a higher mechanical strength than another polymer material. It may be preferred that a mixture of polymers is used, having different weight average molecular weights, for example a mixture of PVA or a copolymer thereof of a weight average molecular weight of 10,000 to 40,000, preferably around 20,000, and of PVA or copolymer thereof, with a weight average molecular weight of 100,000 to 300,000, preferably around 150,000.

Also useful are polymer blend compositions, for example comprising hydrolytically degradable and water-soluble polymer blend such as polylactide and polyvinyl alcohol, achieved by the mixing of polylactide and polyvinyl alcohol, typically comprising 1% to 60% by weight polylactide and approximately from 40% to 99% by weight polyvinyl alcohol.

It may be preferred that the polymer present in the film is from 60% to 98% hydrolysed, preferably from 80% to 90%, to improve the dissolution of the film.

Most preferred films are films which comprise a PVA polymer with similar properties to the film which comprises a PVA polymer and is known under the trade reference M8630, as sold by Monosol LLC of Gary, Ind., U.S. Another preferred film is known under the trade reference PT-75, sold by Aicello Chemical Europe GmbH, Carl-Zeiss-Strasse 43, 47445 Moers, DE.

The film herein may comprise other additive ingredients besides the polymer or polymer material. For example, it may be beneficial to add plasticisers, for example glycerol, ethylene glycol, diethyleneglycol, propylene glycol, sorbitol and mixtures thereof, additional water, disintegrating aids. It may be useful when the composition herein is a detergent composition, that the film itself comprises a detergent additive to be delivered to the wash water, for example, organic polymeric soil release agents, dispersants, dye transfer inhibitors.

The pouch herein comprises a fabric treatment composition, and typically the composition is contained in the volume space of the pouch.

2, Fabric Treatment Composition

Unless stated otherwise all percentages herein are weight percent of the final composition excluding the pouch film forming material.

The pouch contains a liquid fabric treatment composition. By the term "liquid" it is meant that the composition needs to have a fluid viscosity as to be pourable. The fabric treatment composition can be in the form of a conventional liquid, or a gel.

The fabric treatment composition must contain a fabric cleaning system, comprising more than 5% by weight of the fabric treatment composition of at least one anionic surfactant, and a fabric softening system comprising at least one non-cationic fabric softening active selected from the group consisting of fabric softening clays, fabric softening silicones, and mixtures thereof.

2.1, Fabric Cleaning System

One essential element of the compositions used in the present invention is a fabric cleaning system. Generally, the surfactant is present at levels above 5%, preferably between 10% to 80% and more preferably from 20% to 60% by weight of the fabric treatment composition. Such a fabric cleaning system comprises at least one anionic surfactant. In a preferred embodiment of the present invention, the cleaning system further comprises a detersive surfactant selected from the group consisting of nonionic, cationic, zwitterionic, and amphoteric surfactants, and mixtures thereof and described in detail hereinafter. In a more preferred embodiment of the present invention, at least 50% wt. of total surfactant in the cleaning system comprises non-alkoxylated anionic surfactants and less than 50% wt. of total surfactants in the cleaning system comprises alkoxylated surfactants. In an even more preferred embodiment of the present invention, a cleaning system surfactant system with at least 50% wt. of all surfactants being a non-alkoylated surfactant and less than 50% wt. of all surfactants being an alkoxylated surfactant is used in combination with the fabric softening system of the present invention. In another even more preferred embodiment of the present invention, at least 75% wt. of total surfactant in the cleaning system comprises non-alkoxylated anionic surfactants and less than 25% wt. of total surfactants-in the cleaning system comprises alkoxylated surfactants. In the most preferred embodiment of the present invention, a cleaning system surfactant system with at least 75% wt. of all surfactants being a non-alkoylated surfactant and less than 25% wt. of all surfactants being an alkoxylated surfactant is used in combination with the fabric softening system of the present invention.

(a) Anionic Surfactants—In principle, any anionic surfactant is suitable for the purpose of the present invention. However, certain anionic surfactants as described hereinafter are more preferred.

Preferably, at least an anionic surfactant is present, preferably at least an sulfonic acid surfactant, such as a linear alkyl benzene sulfonic acid, but salt forms may also be used. Preferably, at least an anionic surfactant and an nonionic surfactant are present in the fabric cleaning system.

The anionic surfactant(s), are preferably present at levels of at least 7.5% by weight of the fabric treatment composition. More preferably anionic surfactant is present at levels of from 10% or even at least 15%, or even from 22.5% by weight of the fabric treatment composition.

Anionic sulfonate or sulfonic acid surfactants suitable for use herein include the acid and salt forms of a $C_5$-$C_{20}$, more preferably a $C_{10}$-$C_{16}$, more preferably a $C_{11}$-$C_{13}$ alkylbenzene sulfonates, alkyl ester sulfonates, $C_6$-$C_{22}$ primary or secondary alkane sulfonates, sulfonated polycarboxylic acids, and any mixtures thereof, but preferably $C_{11}$-$C_{13}$ alkylbenzene sulfonates.

Anionic sulfate salts or acids surfactants suitable for use in the cleaning system of the compositions of the invention include the primary and secondary alkyl sulfates, having a linear or branched $C_9$-$C_{22}$ alkyl or alkenyl moiety or more preferably $C_{12}$-$C_{18}$ alkyl.

Highly preferred are beta-branched alkyl sulfate surfactants or mixtures of commercial available materials, having a weight average (of the surfactant or the mixture) branching degree of at least 50% or even at least 60% or even at least 80% or even at least 95%. It has been found that these branched sulfate surfactants provide a much better viscosity profile, when clays are present, particular when 5% or more clay is present.

It may be preferred that the only sulfate surfactant is such a highly branched alkyl sulfate surfactant, namely referred may be that only one type of commercially available branched alkyl sulfate surfactant is present, whereby the weight average branching degree is at least 50%, preferably at least 60% or even at least 80%, or even at least 90%. Preferred is for example Isalchem, as available form Condea.

Mid-chain branched alkyl sulfates or sulfonates are also suitable anionic surfactants for use in the cleaning systems of the present invention. Preferred are the mid-chain branched alkyl sulfates. Preferred mid-chain branched primary alkyl sulfate surfactants are of the formula $$CH_3CH_2(CH_2)_wCH(\overset{R}{\overset{|}{C}}H)(CH_2)_xCH(\overset{R^1}{\overset{|}{C}}H)(CH_2)_yCH(\overset{R^2}{\overset{|}{C}}H)(CH_2)_zOSO_3M.$$

These surfactants have a linear primary alkyl sulfate chain backbone (i.e., the longest linear carbon chain which includes the sulfated carbon atom), which preferably comprises from 12 to 19 carbon atoms and their branched primary alkyl moieties comprise preferably a total of at least 14 and preferably no more than 20, carbon atoms. In compositions or components thereof of the invention comprising more than one of these sulfate surfactants, the average total number of carbon atoms for the branched primary alkyl moieties is preferably within the range of from greater than 14.5 to 17.5. Thus, the cleaning system preferably comprises at least one branched primary alkyl sulfate surfactant compound having a longest linear carbon chain of not less than 12 carbon atoms or not more than 19 carbon atoms, and the total number of carbon atoms including branching must be at least 14, and further the average total number of carbon atoms for the branched primary alkyl moiety is within the range of greater than 14.5 to 17.5.

Preferred mono-methyl branched primary alkyl sulfates are selected from the group consisting of: 3-methyl pentadecanol sulfate; 4-methyl pentadecanol sulfate; 5-methyl pentadecanol sulfate; 6-methyl pentadecanol sulfate; 7-methyl pentadecanol sulfate; 8-methyl pentadecanol sulfate; 9-methyl pentadecanol sulfate; 10-methyl pentadecanol sulfate; 11-methyl pentadecanol sulfate; 12-methyl pentadecanol sulfate; 13-methyl pentadecanol sulfate; 3-methyl hexadecanol sulfate; 4-methyl hexadecanol sulfate; 5-methyl hexadecanol sulfate; 6-methyl hexadecanol sulfate; 7-methyl hexadecanol sulfate; 8-methyl hexadecanol sulfate; 9-methyl hexadecanol sulfate; 10-methyl hexadecanol sulfate; 11-methyl hexadecanol sulfate; 12-methyl hexadecanol sulfate; 13-methyl hexadecanol sulfate; 14-methyl hexadecanol sulfate; and mixtures thereof.

Preferred di-methyl branched primary alkyl sulfates are selected from the group consisting of: 2,3-methyl tetradecanol sulfate; 2,4-methyl tetradecanol sulfate; 2,5-methyl tetradecanol sulfate; 2,6-methyl tetradecanol sulfate; 2,7-methyl tetradecanol sulfate; 2,8-methyl tetradecanol sulfate; 2,9-methyl tetradecanol sulfate; 2,10-methyl tetradecanol sulfate; 2,11-methyl tetradecanol sulfate; 2,12-methyl tetradecanol sulfate; 2,3-methyl pentadecanol sulfate; 2,4-methyl pentadecanol sulfate; 2,5-methyl pentadecanol sulfate; 2,6-methyl pentadecanol sulfate; 2,7-methyl pentadecanol sulfate; 2,8-methyl pentadecanol sulfate; 2,9-methyl pentadecanol sulfate; 2,10-methyl pentadecanol sulfate; 2,11-methyl pentadecanol sulfate; 2,12-methyl pentadecanol sulfate; 2,13-methyl pentadecanol sulfate; and mixtures thereof.

It is preferred that the anionic surfactants herein are present in the form of their sodium salts, ammonium salts or mixtures thereof. In an even more preferred embodiment of the present invention, the anionic surfactants herein are present in form of their mono-, di-, or trialkyl ammonium salt, or mixtures thereof. In the most preferred embodiment of the present invention, the anionic surfactants herein are present in form of their monoethanolammonium salt.

(b) Nonionic Surfactants—In principle, any nonionic surfactant is suitable for use in the cleaning system of the present invention. However, certain nonionic surfactants as described herein after are more preferred.

Essentially any alkoxylated nonionic surfactants can be comprised by the composition herein. Ethoxylated and propoxylated nonionic surfactants are preferred. Preferred alkoxylated surfactants can be selected from the classes of the nonionic condensates of alkyl phenols, nonionic ethoxylated alcohols, nonionic ethoxylated/propoxylated fatty alcohols, and mixtures thereof.

Highly preferred are nonionic alkoxylated alcohol surfactants, being the condensation products of aliphatic alcohols with from 1 to 75 moles of alkylene oxide, in particular 50 or from 1 to 15 moles, preferably to 11 moles, particularly ethylene oxide and/or propylene oxide, are highly preferred nonionic surfactants. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from 2 to 9 moles and in particular 5 or 7 moles, of ethylene oxide per mole of alcohol.

Polyhydroxy fatty acid amides are highly preferred nonionic surfactant comprised by the composition, in particular those having the structural formula $R^2CONR^1Z$ wherein: $R^1$ is H, $C_1$-$C_{18}$, preferably $C_1$-$C_4$ hydrocarbyl, 2-hydroxy ethyl, 2-hydroxy propyl, ethoxy, propoxy, or a mixture thereof, preferable $C_1$-$C_4$ alkyl, more preferably $C_1$ or $C_2$ alkyl, most preferably $C_1$ alkyl (i.e., methyl); and $R^2$ is a $C_5$-$C_{31}$ hydrocarbyl, preferably straight-chain $C_5$-$C_{19}$ or $C_7$-$C_{19}$ alkyl or alkenyl, more preferably straight-chain $C_9$-$C_{17}$ alkyl or alkenyl, most preferably straight-chain $C_{11}$-$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

(c) Cationic Surfactants—In principle, any cationic detersive, preferably non-softening, surfactant is suitable for use in the cleaning system of the present invention. However, certain cationic surfactants as described herein after are more preferred.

Preferred are cationic alkoxylated surfactants, and in particular, mono- and bis-alkoxylated quaternary amine surfactants with a $C_6$-$C_{18}$ N-alkyl chain, such as of the general formula I:

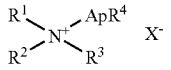

(I)

wherein $R^1$ is an alkyl or alkenyl moiety containing from 6 to 18 carbon atoms, preferably 6 to 16 carbon atoms, most preferably from 6 to 14 carbon atoms; $R^2$ and $R^3$ are each independently alkyl groups containing from one to three carbon atoms, preferably methyl, most preferably both $R^2$ and $R^3$ are methyl groups; $R^4$ is selected from the group consisting of hydrogen (preferred), methyl, ethyl, and mixtures thereof; $X^-$ is an anion such as chloride, bromide, methylsulfate, sulfate, and mixtures thereof, to provide electrical neutrality; A is a alkoxy group, especially a ethoxy, propoxy, butoxy group, and mixtures thereof; and p is from 0 to 30, preferably 2 to 15, most preferably 2 to 8.

The cationic bis-alkoxylated amine surfactant preferably has the general formula II:

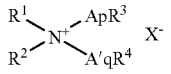

(II)

wherein $R^1$ is an alkyl or alkenyl moiety containing from 8 to 18 carbon atoms, preferably 10 to 16 carbon atoms, most preferably from 10 to 14 carbon atoms; $R^2$ is an alkyl group containing from one to three carbon atoms, preferably methyl; $R^3$ and $R^4$ can vary independently and are selected from the group consisting of hydrogen (preferred), methyl, ethyl, and mixtures thereof; $X^-$ is an anion such as chloride, bromide, methylsulfate, sulfate, and mixtures thereof, sufficient to provide electrical neutrality. A and A' can vary independently and are each selected from the group consisting of $C_1$-$C_4$ alkoxy, especially ethoxy, (i.e., —$CH_2CH_2O$—), propoxy, butoxy, and mixtures thereof, p is from 1 to 30, preferably 1 to 4 and q is from 1 to 30, preferably 1 to 4, and most preferably both p and q are 1.

Another suitable group of cationic surfactants which can be used in the cleaning systems herein are cationic ester surfactants. Suitable cationic ester surfactants, including choline ester surfactants, have for example been disclosed in U.S. Pat. Nos. 4,228,042, 4,239,660 and 4,260,529.

(d) Amphoteric and zwitterionic surfactant—Suitable amphoteric or zwitterionic detersive surfactants for use in the cleaning system herein include those which are known for use in hair softening or other personal softening cleansing. Concentration of such amphoteric detersive surfactants preferably ranges from 0.0% to 20%, preferably from 0.5% to 5% bu weight of the fabric treatment composition. Non-limiting examples of suitable zwitterionic or amphoteric surfactants are described in U.S. Pat. No. 5,104,646 (Bolich Jr. et al.), U.S. Pat. No. 5,106,609 (Bolich Jr. et al.).

Amphoteric detersive surfactants suitable for use in the cleaning system of the present invention are well known in the art, and include those surfactants broadly described as derivatives of aliphatic secondary and tertiary amines in which the aliphatic radical can be straight or branched chain and wherein one of the aliphatic substituents contains from 8 to 18 carbon atoms and one contains an anionic group such as carboxy, sulfonate, sulfate, phosphate, or phosphonate. Suitable amphoteric detersive surfactants for use in the present invention include cocoamphoacetate, cocoamphodiacetate, lauroamphoacetate, lauroamphodiacetate, and mixtures thereof.

Zwitterionic detersive surfactants suitable for use in the cleaning systems of the present invention are well known in the art, and include those surfactants broadly described as derivatives of aliphatic quaternary ammonium, phosphonium, and sulfonium compounds, in which the aliphatic radicals can be straight or branched chain, and wherein one of the aliphatic substituents contains from 8 to 18 carbon atoms and one contains an anionic group such as carboxy, sulfonate, sulfate, phosphate or phosphonate. Zwitterionics such as betaines are suitable for this invention.

Furthermore, amine oxide surfactants having the formula: $R(EO)_x(PO)_y(BO)_zN(O)(CH_2R')_2.qH_2O$ (I) are also suitable for incorporation within the compositions of the present invention. R is a relatively long-chain hydrocarbyl moiety which can be saturated or unsaturated, linear or branched, and can contain from 8 to 20, preferably from 10 to 16 carbon atoms, and is more preferably $C_{12}$-$C_{16}$ primary alkyl. R' is a short-chain moiety preferably selected from the group consisting of hydrogen, methyl, —$CH_2OH$, and mixtures thereof. When x+y+z is different from 0, EO is ethyleneoxy, PO is propyleneneoxy and BO is butyleneoxy. Amine oxide surfactants are illustrated by $C_{12}$-14 alkyldimethyl amine oxide.

Non-limiting examples of other anionic, zwitterionic, amphoteric or optional additional surfactants suitable for use in the compositions are described in McCutcheon's, Emulsifiers and Detergents, 1989 Annual, published by M. C. Publishing Co., and U.S. Pat. Nos. 3,929,678; 2,658,072; 2,438,091; and 2,528,378.

(e) Mixtures thereof: Mixtures of the above components can be made in any proportion.

2.2, Fabric Softening System

The second essential element of the fabric treatment compositions used in the present invention is a fabric softening system. Preferably, the fabric softening system is present at levels of between 0.01% to 20%, more preferably between 0.1% to 15%, and most preferably between 0.5% to 10% by weight of the fabric treatment composition. Such a fabric softening system comprises at least one non-cationic fabric softening active selected from the group consisting of fabric softening clays, fabric softening silicones, and mixtures thereof.

(1) Fabric Softening Clay—

Clays can be present in the fabric softening system of the present invention. Preferred clays are of the smectite type.

Smectite type clays are widely used as fabric softening ingredients in detergent compositions. Most of these clays have a cation exchange capacity of at least 50 meq/100 g.

Smectite clays can be described as three-layer expandable materials, consisting of alumino-silicates or magnesium silicates.

There are two distinct classes of smectite-type clays; in the first, aluminium oxide is present in the silicate crystal lattice, in the second class of smectites, magnesium oxide is present in the silicate crystal lattice.

The general formulas of these smectites are $Al_2(Si_2O_5)_2(OH)_2$ and $Mg_3(Si_2O_5)(OH)_2$, for the aluminium and magnesium oxide type clay, respectively. The range of the water of hydration can vary with the processing to which the clay has been subjected. Furthermore, atom substitution by iron and magnesium can occur within the crystal lattice of the smectites, while metal cations such as $Na^+$, $Ca^{2+}$, as well as $H^+$ can be co-present in the water of hydration to provide electrical neutrality.

It is customary to distinguish between clays on the basis of one cation predominantly or exclusively absorbed. For example, a sodium clay is one in which the absorbed cation is predominately sodium. Such absorbed cations can become involved in equilibrium exchange reactions with cations present in aqueous solutions. In such equilibrium reactions, one equivalent weight of solution cation replaces an equivalent of sodium, for example, and it is customary to measure clay cation exchange capacity in terms of milliequivalents per 100 g of clay (meq/100 g).

The cation exchange capacity of clays can be measured in several ways, including electrodialysis, by exchange with ammonium ion followed by titration, or by a methylene blue procedure, all as set forth in Grimshaw, The Chemistry and Physics of Clays, Interscience Publisher, Inc. pp. 264-265 (1971). The cation exchange capacity of a clay mineral relates to such factors as the expandable properties of the clay, the charge of the clay, which in turn is determinated at least in part by the lattice structure. The ion exchange capacity of clays varies widely in the range from 2 meq/10 g for kaolinites to 150 meq/100 g and greater for certain clays of the montmorillonite variety. Illite clays have an ion exchange capacity somewhere in the lower portion of the range, c. 26 mew/100 g for an average illite clay.

It has been determined that illite and kaolinite clays, with their relatively low ion exchange capability, are not useful in the fabric softening system of the fabric treatment compositions of the present invention. Indeed such illite and kaolinite clays constitute a major component of clay soils. However, smectites, such as nontronite having an ion exchange capacity of approximately 50 meq/100 g; saponite, which has an ion exchange capacity greater than 70 meq/100 g, have been found to be useful fabric softening actives in the fabric softening system of the present invention.

The smectite clays commonly used for this purpose herein are all commercially available. Such clays include, for example, montmorillonite, volchonskoite, nontronite, hectorite, paonite, sauconite, and vermiculite. The clays herein are available under commercial names such as "fooler clay" (clay found in a relatively thin vein above the main bentonite or monmorillonite veins in the Black Hills) and various tradenames such as Thixogel #1 (also, "Thixo-Jell") and Gelwhite GP from Georgia Kaolin Co. Elizabeth, N.J.; Volclay BC and Volclay #325, from American Colloid Co., Skokie, Ill.; Black Hills Bentonite BH 450, from International Minerals and Chemicals; and Veegum Pro and Veegum F, from R.T. Vanderbuilt. It is to be recognized that such smectite-type minerals obtained under the foregoing commercial and tradenames can comprise mixtures of the various discrete mineral entitites. Such mixtures of the smecite minerals are suitable for use herein.

Preferred for use herein are the montmorrillonite clays having an ion exchange capacity of 50 to 100 meq/10 g which corresponds to ca. 0.2 to 0.6 layer charge.

Quite suitable are hectorites of natural origin, in the form of particles having the general formula:

$$[(Mg_{3-x}Li_x)Si_{4-y}Me^{III}_yO_{10}(OH_{2-z}F_z)]^{-(x+y)}(x+y)/n\ M^{n+}$$

wherein $Me^{III}$ is Al, Fe, or B; or y=o; $M^{n+}$ is a monovalent (n=1) or divalent (n=2) metal ion, for example selected from the group consisting of Na, K, Mg, Ca, Sr, and mixtures thereof. In the above formula, the value of (x+y) is the layer charge of the hectorite clay. Such hectorite clays are preferably selected on the basis of their layer charge properties, i.e. at least 50% is in the range of from 0.23 to 0.31. More suitable are hectorite clays of natural origin having a layer charge distribution such that at least 65% is in the range of from 0.23 to 0.31.

The hectorite clays suitable in the present composition should preferably be sodium clays, for better softening activity.

Sodium clays are either naturally occurring, or are naturally-occurring calcium-clays which have been treated so as to convert them to sodium-clays. If calcium-clays are used in the present compositions, a salt of sodium can be added to the compositions in order to convert the calcium clay to a sodium clay. Preferably, such a salt is sodium carbonate, typically added at levels of up to 5% of the total amount of clay.

Examples of hectorite clays suitable for the present compositions include Bentone EW and Macaliod, from NL Chemicals, NJ, US, and hectorites from Industrial Mineral Ventures.

Another preferred clay is an organophilic clay, preferably a smectite clay, whereby at least 30% or even at least 40% or preferably at least 50% or even at least 60% of the exchangeable cations is replaced by a, preferably long-chain, organic cations. Such clays are also referred to as hydrophobic clays.

Whilst the organophilic smectite clay provides excellent softening benefit, they can increase the viscosity of the liquid compositions. Therefore, it will depend on the viscosity requirements of the composition, how much of these organophlic clays can be used.

These organophilic clays are formed prior to incorporation into the detergent composition. Thus for example, the cations, or part thereof, of the normal smectite clays are replaced by the long-chain organic cations to form the organophilic smectite clays herein, prior to further processing of the material to form the detergents of the invention.

The organophilic clay is preferably in the form of a platelet or lath-shaped particle. Preferably the ratio of the width to the length of such a platelet is at least 1:2, preferably at least 1:4 or even at least 1:6 or even at least 1:8.

When used herein, a long-chain organic cation can be any compound which comprises at least one chain having at least 6 carbon atoms, but typically at least 10 carbon atoms, preferably at least 12 carbon atoms, or in certain embodiments of the invention, at least 16 or even at least 18 carbon atoms. Preferred long-chain organic cations are described hereinafter.

Preferred organophilic clays herein clay are smectite clays, preferably hectorite clays and/or montmorillonite clays containing one or more organic cations of formulae:

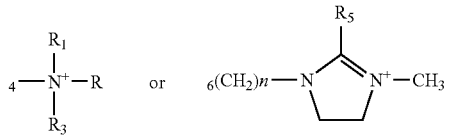

where $R_1$ represents an organic radical selected from the group consisting of $R_7$, $R_7$—CO—O—$(CH_2)_n$, $R_7$—CO—$NR_8$—, and mixtures thereof, in which $R_7$ is an alkyl, alkenyl or alkylaryl group with 12 to 22 carbon atoms, whereby $R_8$ is hydrogen, $C_1$-$C_4$ alkyl, alkenyl or hydroxyalkyl, preferably —$CH_3$ or —$C_2H_5$ or —H; n is an integer, preferably equal to 2 or 3; $R_2$ represents an organic radical selected from the group consisting of $R_1$ or $C_1$-$C_4$ alkyl, alkenyl or hydroxyalkyl, preferably —$CH_3$ or —$CH_2CH_2OH$, and mixtures thereof; $R_3$ and $R_4$ are organic radicals selected from the group consisting of $C_1$-$C_4$ alkyl-aryl, $C_1$-$C_4$ alkyl, alkenyl or hydroxyalkyl, preferably —$CH_3$, —$CH_2CH_2OH$, or benzyl group, and mixtures thereof; $R_5$ is an alkyl or alkenyl group with 12-22 carbon atoms, and mixtures thereof; $R_6$ is preferably —OH, —NHCO—$R_7$, —OCO—$R_7$, and mixtures thereof.

Highly preferred cations are quaternary ammonium cations having two $C_{16}$-$C_{28}$ or even $C_{16}$-$C_{24}$ alkyl chains. Highly preferred are one or more organic cations which have one or preferably two alkyl groups derived from natural fatty alcohols, the cations preferably being selected from the group consisting of dicocoyl methyl benzyl ammonium, dicocoyl ethyl benzyl ammonium, dicocoyl dimethyl ammonium, dicocoyl diethyl ammonium, and mixtures thereof; more preferably ditallow diethyl ammonium, ditallow ethyl benzyl ammonium, and mixtures thereof; most preferably ditallow dimethyl ammonium, ditallow methyl benzyl ammonium, and mixtures thereof. It may be highly preferred that mixtures of organic cations are present.

Highly preferred are organophilic clays as available from Rheox/Elementis, such as Bentone SD-1 and Bentone SD-3, which are registered trademarks of Rheox/Elementis.

Clays are well known in the art for their fabric softening performance. In general, clays are usually processed as aqueous suspensions. However, the use of aqueous suspensions of fabric softening clays is not acceptable when the final composition is surrounded by a water-soluble pouch, because the water content present would lead at least partly to an early and therefore unwanted dissolution of the pouch material, i.e. before the consumer places the pouch in the washing machine, and therefore resulting in loss of treatment composition available for the laundry cycle and/or causing a mess in the consumers home. In order to overcome this technical problem, the present invention suggests adding clays as premixes. These premixes comprise the clay and a solvent, preferably a non-aqueous solvent. Due to the dissolution profile of most clays, the premix is most likely a slurry or dispersion or suspension or emulsion of the clay in the solvent. The solvent is more preferably an organic solvent, and even more preferably an organic solvent selected from the group consisting of $C_1$-$C_{20}$ linear, branched, cyclic, saturated or unsaturated alcohols with one or more free hydroxy groups; amines, alkanolamines; and mixtures thereof. Most preferred solvents include monoalcohols, diols, monoamine derivatives, glycerols, glycols, and mixtures thereof, such as ethanol, propanol, propandiol, monoethanolamin, glycerol, sorbitol, alkylene glycols, polyalkylene glycols, and mixtures thereof. By utilizing premixes of fabric softening clays and solvents, process problems in terms of proper dispersion or dissolution of all ingredients throughout the composition have been overcome as well.

(b) Fabric softening silicone—Fabric softening silicones can be present in the fabric softening system of the present invention.

Specific examples of silicone polymers are disclosed in "Silicone Surfactants, Editor: R. M. Hill, Surfactant Science Series, Vol. 86, Marcel Dekker, Inc., 1999".

Preferably, the silicone polymer is selected from the group consisting of nonionic nitrogen-free silicone polymers having the formulae (I) to (III):

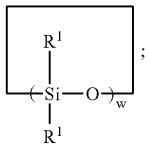

(I)

$$R^2—(R^1)_2SiO—[(R^1)_2SiO]_a—[(R^1)(R^2)SiO]_b—Si(R^1)_2—R^2 \quad \text{(II);}$$

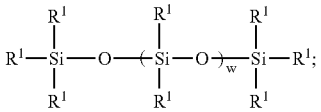

(III)

and mixtures thereof, wherein each $R^1$ is independently selected from the group consisting of linear, branched or cyclic substituted or unsubstituted alkyl groups having from 1 to 20 carbon atoms; linear, branched or cyclic substituted or unsubstituted alkenyl groups having from 2 to 20 carbon atoms; substituted or unsubstituted aryl groups having from 6 to 20 carbon atoms; substituted or unsubstituted alkylaryl, substituted or unsubstituted arylalkyl and substituted or unsubstituted arylalkenyl groups having from 7 to 20 carbon atoms, and mixtures thereof; each $R^2$ is independently selected from the group consisting of linear, branched or cyclic substituted or unsubstituted alkyl groups having from 1 to 20 carbon atoms; linear, branched or cyclic substituted or unsubstituted alkenyl groups having from 2 to 20 carbon atoms; substituted or unsubstituted aryl groups having from 6 to 20 carbon atoms; substituted or unsubstituted alkylaryl groups, substituted or unsubstituted arylalkyl, substituted or unsubstituted arylalkenyl groups having from 7 to 20 carbon atoms and from a poly(ethyleneoxide/propyleneoxide) copolymer group having the general formula (IV):

$$—(CH_2)_nO(C_2H_4O)_c(C_3H_6O)_dR^3 \quad \text{(IV)}$$

with at least one $R^2$ being a poly(ethyleneoxy/propyleneoxy) copolymer group, and each $R^3$ is independently selected from the group consisting of hydrogen, an alkyl having 1 to 4 carbon atoms, an acetyl group, and mixtures thereof, wherein the index w has the value as such that the viscosity of the nitrogen-free silicone polymer of formulae (I) and (III) is between $2\cdot10^{-6}$ $m^2/s$ (2 centistokes) and 1 $m^2/s$ (1,000,000 centistokes); wherein a is from 1 to 50; b is from 1 to 50; n is 1 to 50; total c (for all polyalkyleneoxy side groups) has a value of from 1 to 100; total d is from 0 to 14; total c+d has a value of from 5 to 150.

More preferably, the nitrogen-free silicone polymer is selected from the group consisting of linear nonionic nitrogen-free silicone polymers having the formulae (II) to (III) as above, wherein $R^1$ is selected from the group consisting of methyl, phenyl, and phenylalkyl; wherein $R^2$ is selected from the group consisting of methyl, phenyl, phenylalkyl and from the group having the general formula (IV), defined as above; wherein $R^3$ is defined as above and wherein the index w has the value as such that the viscosity of the nitrogen-free silicone polymer of formula (III) is between 0.01 $m^2/s$ (10,000 centistokes) and 0.8 $m^2/s$ (800,000 centistokes); a is from 1 to 30, b is from 1 to 30, n is from 3 to 5, total c is from 6 to 100, total d is from 0 to 3, and total c+d is from 7 to 100.

Most preferably, the nitrogen-free silicone polymer is selected from the group consisting of linear nonionic nitrogen-free silicone polymers having the formula (III) as above, wherein $R^1$ is methyl and wherein the index w has the value as such that the viscosity of the nitrogen-free silicone polymer of formula (III) is between 0.06 $m^2/s$ (60,000 centistokes) and 0.7 $m^2/s$ (700,000 centistokes) and more preferably between 0.1 $m^2/s$ (100,000 centistokes) and 0.48 $m^2/s$ (480,000 centistokes), and mixtures thereof.

The term "unsubstituted" means that R contains the elements carbon and hydrogen only. The term "substituted" means that R comprises carbon and hydrogen and one or more heteroatoms selected from the group consisting of halogen (fluoro, chloro, bromo, iodo), oxygen, sulfur, phosphor, and/or one or more functional groups such as alkyl ethers, carboxylgrops, carboxylalkyl groups, hydroxy groups, hydroxyalkyl groups; and combinations thereof.

Silicones are well known in the art for their fabric softening performance. Usually, these silicones are added as emulsions in water. As states above for the fabric softening clays, the use of aqueous emulsions of fabric softening silicones is not acceptable when the final composition is to be placed in water-soluble pouches. The fabric softening silicones suitable for use in the present invention are either added as a premix comprising the silicone and a solvent, or the silicones are added as pure compounds without any solvent. When the fabric softening silicones are added as a premix, the premix is most likely a slurry or dispersion or suspension or emulsion of the silicone in the solvent. The solvent is preferably non-aqueous solvent, more preferably an organic solvent, and even more preferably selected from the group consisting of $C_1$-$C_{20}$ linear, branched, cyclic, saturated and/or unsaturated alcohols with one or more free hydroxy groups; amines, alkanolamines, and mixtures thereof. Preferred solvents are monoalcohols, diols, monoamine derivatives, glycerols, glycols, and mixtures thereof, such as ethanol, propanol, propandiol, monoethanolamin, glycerol, sorbitol, alkylene glycols, polyalkylene glycols, and mixtures thereof. Most preferred solvents are selected from the group consisting of 1,2-propandiol, 1,3-propandiol, glycerol, ethylene glycol, diethyleneglycol, and mixtures thereof. In a preferred embodiment of the present invention, premixes comprising fabric softening silicones and solvents arc utilized in order to overcome process problems in terms of proper dispersion or dissolution of all ingredients throughout the composition.

Non-limiting examples of nitrogen-free silicone polymers of fomula (II) are the Silwet® compounds which are available from OSI Specialties Inc., a Division of Witco, Danbury, Conn. Non-limiting examples of nitrogen-free silicone polymers of fomula (I) and (III) are the Silicone 200 Fluid®-series from Dow Corning.

(c) Mixtures thereof—Mixtures of the above components can be made in any proportion.

PREFERRED EMBODIMENTS

Preferably the fabric treatment composition of the present invention is contained in the inner volume space of the pouch.

The liquid fabric treatment composition is generally non-aqueous. For the purpose of the present invention, the composition is non-aqueous if it contains less than 15% wt., preferably between 2% to 10% wt., more preferably between 3% and 8% wt., and most preferably between 3.5% and 6% by weight of the fabric treatment composition, of water. This is on basis of total water by weight of the total fabric treatment composition.

The liquid composition can made by any method and can have any viscosity, typically depending on its ingredients. The liquid composition preferably has a viscosity of 0.0001 $m^2/s$ (100 centipoises) to 0.1 $m^2/s$ (100,000 centipoises), as measured at a rate of 20 $s^{-1}$, more preferably from 0.0002 $m^2/s$ (200 centipoises) to 0.05 $m^2/s$ (50,000 centipoises), even more preferably from 0.00025 $m^2/s$ (250 centipoises) to 0.01 $m^2/s$ (10,000 centipoises), and most preferably from 0.003 $m^2/s$ (300 centipoises) to 0.001 $m^2/s$ (1,000 centipoises). The liquid compositions herein can be Newtonian or non-Newtonian.

The liquid composition preferably has a density of 0.8 kg/l to 1.3 kg/l, preferably around 1.0 to 1.1 kg/l.

In a preferred embodiment of the present invention, at least one builder is present. More preferably, at least one water-soluble builder is present, and even more preferably at least one fatty acid builder is present. The most preferred builder suitable for incorporation in the compositions of the present invention is citric acid.

Preferred is also the presence of enzymes and preferred may also be to incorporate a bleaching agent, such as a preformed peroxyacid.

The liquid composition comprises preferably a colorant or dye and/or pearlescence agent.

Highly preferred are also perfume, brightener, buffering agents (to maintain the pH preferably from 5.5 to 9, more preferably 6 to 8), and suds suppressors, anti-wrinkling agent.

Highly preferred in all above compositions is the presence of an additional solvent, which is preferably an organic solvent, more preferably selected from the group consisting of $C_1$-$C_{20}$ linear, branched, cyclic, saturated and/or unsaturated alcohols with one or more free hydroxy groups; amines, alkanolamines, and mixtures thereof Even more preferred solvents are monoalcohols, diols, monoamine derivatives, glycerols, glycols, and mixtures thereof, such as ethanol, propanol, propandiol, monoethanolamin, glycerol, sorbitol, alkylene glycols, polyalkylene glycols, and mixtures thereon and most preferred solvents are selected from 1,2-propandiol, 1,3-propandiol, glycerol, ethylene glycol, diethylerieglycol, and mixtures thereof.

The compositions used in the present invention comprise solvents at levels of from 0.1% to 90%, preferably of from 10% to 70%, more preferably of from 12% to 40% and most preferably of from 15% to 30% by weight of the fabric treatment composition.

Adjuncts Ingredients (a) Builder Compounds

The compositions in accordance with the present invention preferably contain a water-soluble builder compound, typically present in detergent compositions at levels of from 1% to 60% by weight, preferably from 3% to 40% by weight, most preferably from 5% to 25% by weight of the composition.

Suitable water-soluble builder compounds include the water soluble monomeric carboxylates, or their acid forms, or homo or copolymeric polycarboxylic acids or their salts in which the polycarboxylic acid comprises at least two carboxylic radicals separated from each other by not more that two carbon atoms, and mixtures of any of the foregoing.

Preferred builder compounds include citrate, tartrate, succinates, oxydissuccinates, carboxymethyloxysuccinate, nitrilotriacetate, and mixtures thereof.

Highly preferred maybe that one or more fatty acids and/or optionally salts thereof (and then preferably sodium salts) are present in the detergent composition. It has been found that this can provide further improved softening and cleaning of the fabrics. Preferably, the compositions comprise from 2% to 40%, more preferably from 5% to 30%, and most preferably 10% to 25% by weight of the composition of a fatty acid or salt thereof. Preferred are in particular $C_{12}$-$C_{18}$ saturated and/or unsaturated, linear and/or branched, fatty acids, but preferably mixtures of such fatty acids. Highly preferred have been found mixtures of saturated and unsaturated fatty acids, for example preferred is a mixture of rape seed-derived fatty acid and $C_{16}$-$C_{18}$ topped whole cut fatty acids, or a mixture of rape seed-derived fatty acid and a tallow alcohol derived fatty acid, palmitic, oleic, fatty alkylsuccinic acids, and mixtures thereof The compositions of the invention may comprise phosphate-containing builder material. Preferably present at levels of from 2% to 40%, more preferably from 5% to 30%, more preferably from 10% to 25%. Suitable examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from 6 to 21, and salts of phytic acid.

The compositions in accord with the present invention may contain a partially soluble or insoluble builder compound, typically present in detergent compositions at levels of from 0.5% to 60% by weight, preferably from 5% to 50% by weight, most preferably from 8% to 40% weight of the composition.

Preferred are aluminosilicates and/or crystalline layered silicates such as SKS-6, available from Clariant.

However, from a formulation point of view it may be preferred not to include such builders in the liquid composition, because it will lead to too much dispersed or precipitate material in the liquid, or it requires too much process or dispersion aids.

(b) Structuring Agent

The compositions in accordance with the present invention preferably contain a structuring agent, typically present of from 0.1% to 20%, preferably from 0.15% to 15%, more preferably from 0.2% to 5% by weight of the fabric treatment composition. The structuring agent serves to stabilize the fabric care compositions herein and to prevent the fabric treatment compositions herein from coagulating and/or creaming.

Preferably the structuring agent is a crystalline, hydroxyl-containing structuring agent, more preferably still, a trihydroxystearin, hydrogenated oil or a variation thereof.

Without intending to be limited by theory, the crystalline, hydroxyl-containing stabilizing agent is a nonlimiting example of an agent which forms a "thread-like structuring system." "Thread-like Structuring System" as used herein means a system comprising one or more agents that are capable of providing a chemical network that reduces the tendency of materials with which they are combined to coalesce and/or phase split. Examples of the one or more agents include crystalline, hydroxyl-containing stabilizing agents and/or hydrogenated jojoba. Without wishing to be bound by theory, it is believed that the thread-like structuring system forms a fibrous or entangled threadlike network in-situ on cooling of the matrix. The thread-like structuring system has an average aspect ratio of from 1.5:1, preferably from at least 10:1, to 200:1.

The thread-like structuring system can be made to have a viscosity of 2000 cstks or less at an intermediate shear range ($5\ s^{-1}$ to $50\ s^{-1}$) which allows for the pouring of the composition out of a standard bottle, while the low shear viscosity of the product at $0.1\ s^{-1}$ can be at least 2000 cstks but more preferably greater than 20,000 cstks. A process for the preparation of a thread-like structuring system is disclosed in WO 02/18528.

Crystalline, hydroxyl-containing stabilizing agents can be fatty acid, fatty ester or fatty soap water-insoluble wax-like substance.

The crystalline, hydroxyl-containing stabilizing agents in accordance with the present invention are preferably derivatives of castor oil, especially hydrogenated castor oil derivatives. For example, castor wax.

The crystalline, hydroxyl-containing agent typically is selected from the group consisting of:

i)

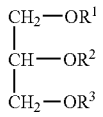

wherein $R^1$ is —C(O)$R^4$, $R^2$ is $R^1$ or H, $R^3$ is $R^1$ or H, and $R^4$ is independently $C_{10}$-$C_{22}$ alkyl or alkenyl comprising at least one hydroxyl group;

ii)

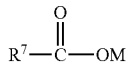

wherein:

$R^7$ is

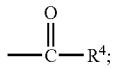

$R^4$ is as defined above in i);

M is $Na^+$, $K^+$, $Mg^{++}$ or $Al^{3+}$, or H; and iii) mixtures thereof.

Alternatively, the crystalline, hydroxyl-containing stabilizing agent may have the formula:

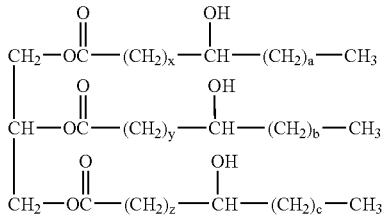

wherein:

(x+a) is from between 11 and 17; (y+b) is from between 11 and 17; and (z+c) is from between 11 and 17. Preferably, wherein x=y=z=10 and/or wherein a=b=c=5.

Commercially available crystalline, hydroxyl-containing stabilizing agents include THIXCIN® from Rheox, Inc.

(c) Perfume

Highly preferred are perfume components, preferably at least one component comprising a coating agent and/or carrier material, preferably organic polymer carrying the perfume or alumniosilicate carrying the perfume, or an encapsulate enclosing the perfume, for example starch or other cellulosic material encapsulate. The inventors have found that the perfumes are more efficiently deposited onto the fabric in the compositions of the invention.

Preferably the pouch compositions of the present invention comprise from 0.01% to 4% of perfume, more preferably from 0.1% to 2%.

(d) Bleaching Agent

The compositions herein may also optionally comprise from 0.005% to 10% by weight of a bleaching agent. The bleaching agent may be present as a perhydrate bleach, such as salts of percarbonates, particularly the sodium salts, and/or organic peroxyacid bleach precursor, and/or transition metal bleach catalysts, especially those comprising Mn or Fe. It has been found that when the pouch or compartment is formed from a material with free hydroxy groups, such as PVA, the preferred bleaching agent comprises a percarbonate salt and is preferably free form any perborate salts or borate salts. It has been found that borates and perborates interact with these hydroxy-containing materials and reduce the dissolution of the materials and also result in reduced performance.

Inorganic perhydrate salts are a preferred source of peroxide. Examples of inorganic perhydrate salts include percarbonate, perphosphate, persulfate and persilicate salts. The inorganic perhydrate salts are normally the alkali metal salts. Alkali metal percarbonates, particularly sodium percarbonate are preferred perhydrates herein.

The composition herein preferably comprises a peroxy acid or a precursor therefor (bleach activator), preferably comprising an organic peroxyacid bleach precursor. It may be preferred that the composition comprises at least two peroxy acid bleach precursors, preferably at least one hydrophobic peroxyacid bleach precursor and at least one hydrophilic peroxy acid bleach precursor, as defined herein. The production of the organic peroxyacid occurs then by anin-situ reaction of the precursor with a source of hydrogen peroxide. The hydrophobic peroxy acid bleach precursor preferably comprises a compound having a oxy-benzene sulphonate group, preferably NOBS, DOBS, LOBS and/or NACA-OBS. The hydrophilic peroxy acid bleach precursor preferably comprises TAED.

Amide substituted alkyl peroxyacid precursor compounds can be used herein. Suitable amide substituted bleach activator compounds are described in EP-A-0 170 386.

The composition may contain a pre-formed organic peroxyacid. A preferred class of organic peroxyacid compounds is described in EP-A-170 386. Other organic peroxyacids include diacyl and tetraacylperoxides, especially diperoxydodecanedioc acid, diperoxytetradecanedioc acid and diperoxyhexadecanedioc acid. Mono- and diperazelaic acid, mono- and diperbrassylic acid and N-phthaloylaminoperoxicaproic acid are also suitable herein.

(e) Suds Suppressing System

The composition may comprise a suds suppresser at levels of less than 10%, preferably 0.001% to 10%, preferably from 0.01% to 8%, most preferably from 0.05% to 5%, by weight of the composition. Preferably the suds suppresser is either a soap, paraffin, wax, or any combination thereof. If the suds suppresser is a suds suppressing silicone, then the composition preferably comprises from 0.005% to 0.5% by weight a suds suppressing silicone. Suitable suds suppressing systems for use herein may comprise essentially any known antifoam compound, including for example silicone antifoam compounds and 2-alkyl alcanol antifoam compounds.

Other suitable antifoam compounds include the monocarboxylic fatty acids and soluble salts thereof, as also described as builders above. These materials are described in U.S. Pat. No. 2,954,347, issued Sep. 27, 1960 to Wayne St. John. The monocarboxylic fatty acids, and salts thereof, for use as suds suppressor typically have hydrocarbyl chains of 10 to 24 carbon atoms, preferably 12 to 18 carbon atoms. Suitable salts include the alkali metal salts such as in particular sodium but also potassium salts.

(f) Enzymes

Another preferred ingredient useful in the compositions herein is one or more enzymes.

Suitable enzymes include enzymes selected from the group consisting of peroxidases, proteases, gluco-amylases, amylases, xylanases, cellulases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, dextranase, transferase, laccase, mannanase, xyloglucanases, or mixtures thereof. Detergent compositions generally comprise a cocktail of conventional applicable enzymes like protease, amylase, cellulase, lipase.

Enzymes are generally incorporated in detergent compositions at levels of from 0.0001% to 2%, preferably from 0.001% to 0.2%, more preferably from 0.005% to 0.1% pure enzyme by weight of the composition.

The above-mentioned enzymes may be of any suitable origin, such as vegetable, animal, bacterial, fungal and yeast origin. Origin can further be mesophilic or extremophilic (psychrophilic, psychrotrophic, thermophilic, barophilic, alkalophilic, acidophilic, halophilic, etc.). Purified or non-purified forms of these enzymes may be used. Nowadays, it is common practice to modify wild-type enzymes via protein/genetic engineering techniques in order to optimize their performance efficiency in the detergent compositions of the invention. For example, the variants may be designed such that the compatibility of the enzyme to commonly encountered ingredients of such compositions is increased. Alternatively, the variant may be designed such that the optimal pH, bleach or chelant stability, catalytic activity and the like, of the enzyme variant is tailored to suit the particular cleaning application. In regard of enzyme stability in liquid detergents, attention should be focused on amino acids sensitive to oxidation in the case of bleach stability and on surface charges for the surfactant compatibility. The isoelectric point of such enzymes may be modified by the substitution of some charged amino acids. The stability of the enzymes may be further enhanced by the creation of e.g. additional salt bridges and enforcing metal binding sites to increase chelant stability. Furthermore, enzymes might be chemically or enzymatically modified, e.g. PEG-ylation, cross-linking and/or can be immobilized, i.e. enzymes attached to a carrier can be applied.

The enzyme to be incorporated in a detergent composition can be in any suitable form, e.g. liquid, encapsulate, prill, granulate or any other form according to the current state of the art.

(R) Organic Polymeric Compounds

The compositions herein may also optionally comprise from 0.005% to 10% by weight of organic polymeric compounds. Useful additional non-alkoxylated organic polymeric compounds for inclusion in the compositions herein include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of MWt 1000-5000 and their copolymers with maleic anhydride, such copolymers having a molecular weight of from 2000 to 100,000, especially 40,000 to 80,000.

Other organic polymeric compounds suitable for incorporation in the compositions herein include cellulose derivatives.

(h) Dye-Transfer Inhibitors

The compositions herein may also comprise from 0.01% to 10%, preferably from 0.05% to 0.5% by weight of polymeric dye transfer inhibiting agents. The polymeric dye transfer inhibiting agents are preferably selected from the group consisting of polyarmine N-oxide polymers, copolymers of N-vinylpyrrolidone and N-vinylimidazole, polyvinylpyrrolidone-polymers and combinations thereof, whereby these polymers can be cross-linked polymers.

(i) Brighteners

The compositions herein may also optionally comprise from 0.005% to 5% by weight of optical brighteners.

Preferred brighteners include 4,4',-bis[(4-anilino-6-(N-2-bis-hydroxyethyl)-s-triazine-2-yl)amino]-2,2'-stilbenedisulfonic acid and disodium salt, commercially marketed under the tradename Tinopal-UNPA-GX by Ciba-Geigy Corporation; 4,4'-bis[(4-anilino-6-(N-2-hydroxyethyl-N-methylamino)-s-triazine-2-yl)amino]2,2'-stilbene disulfonic acid disodium salt, commercially marketed under the tradename Tinopal 5BM-GX by Ciba-Geigy Corporation; 4,4'-bis[(4-anilino-6-morphilino-s-triazine-2-yl)amino]2,2'-stilbenedisulfonic acid, sodium salt, commercially marketed under the tradename Tinopal-DMS-X and Tinopal AMS-GX by Ciba Geigy Corporation.

(j) Alkoxylated Amine, Imine, Amide, Imide Compound

The composition may optionally comprise one or more alkoxylated compounds having at least two alkoxylated amine, imine, amide or imide groups.

Preferred are compounds having at least two alkoxylated amine groups.

The alkoxylation group may have one or more alkoxylates, typically more than one, thus forming a chain of alkoxylates, or polyalkoxylation group.

The compound may have two alkoxylation groups or chain, preferably at least 4 or even at least 7 or even at least 10 or even at least 16. Preferred is that the alkoxylation groups are polyalkoxylation groups, (each independently) having an average alkoxylation degree of at least 5, more preferably at least 8, preferably at least 12, up to preferably 80 or even to 50 or even to 25.

The (poly)alkoxylation is preferably a (poly)ethoxylation and/ or (poly)propoxylation. Thus, preferred is that the alkoxylation group is a polyethoxylation group or polypropoxylation group, or a (poly)ethoxylation/ (poly)propoxyltion group.

Preferred may be that these compounds are polymers having such groups. When used herein a polymer is a compound having 2 or more repeating monomer units forming a backbone. The alkoxylated polymer herein is preferably such that the alkoxylation groups are not part of the backbone of the polymer, but are alkoxylation groups of the amine, imine, amide or imide in the units forming the backbone, or are alkoxylation groups of other side-groups chemically bound to the backbone.

Said alkoxylated compound is preferably a polyamide, polyimide or more preferably a polyamine or polyime compound, whereby these amide, imide, amine or imine units are present as backbone of the polymer, forming the chain of repeating units. Preferably, these polymers have at least 3 or even 4 or even 5 amide, imide, amine or imine units. Hereby, it may be preferred that only some of the amine or imine are alkoxylated.

It may be preferred that the backbone has also side-chains containing amide, imide, amine or imine groups, which may be alkoxylated.

Preferred are compounds having a weight average molecular weight of 200 to 50,000, preferably to 20,000 or even to 10,000, or even from 350 to 5000 or even to 2000 or even to 1000.

Preferably the composition herein (described in more detail hereinafter) comprises (by weight of the composition) from 0.5% to 15%, more preferably from 0.8% to 10%, more preferably form 1.5% to 8%, more preferably from 2.0% or even 2.5% or even 3% to 6% of said alkoxylated compound. The composition herein may comprise preferably mixtures of the specified compounds.

Highly preferred are ethoxylated poly(ethyleneimine), preferably having an average ethoxylationd degree per ethoxylation chain of 15 to 25, and a molecular weight of 1000-2000 dalton. Also highly preferred are ethoxylated tetraethylene pentaimines.

(k) Chelating Agents

The composition herein can comprise a chelating agent, for example, having two or more phosphonic acid or phosphonate groups, or two or more carboxylic acid or carboxylate groups, or mixtures thereof. By chelating agent it is meant herein components which act to preferentially sequester (chelate) heavy metal ions, but these components may also have calcium and magnesium chelation capacity.

Chelating agents are generally present at levels of from 1%, preferably from 2.5% from 3.5% or even 5.0% or even 7% and preferably up to 20% or even 15% or even 10% by weight of the composition herein.

Highly suitable organic phosphonates herein are amino alkylene poly (alkylene phosphonates), alkali metal ethane 1-hydroxy bisphosphonates and nitrilo trimethylene phosphonates. Preferred among the above species are diethylene triamine penta (methylene phosphonate), ethylene diamine tri (methylene phosphonate) hexamethylene diamine tetra (methylene phosphonate) and hydroxy-ethylene 1,1 diphosphonate.

Other suitable chelating agents for use herein include nitrilotriacetic acid and polyaminocarboxylic acids such as ethylenediaminotetracetic acid, ethylenetriamine pentacetic acid, ethylenediamine disuccinic acid, ethylenediamine diglutaric acid, 2-hydroxypropylenediamine disuccinic acid or any salts thereof. Especially preferred is ethylenediamine-N,N'-disuccinic acid (EDDS) or the alkali metal, alkaline earth metal, ammonium, or substituted ammonium salts thereof, or mixtures thereof. Glycinamide-N,N'-disuccinic acid (GADS), ethylenediamine-N-N'-diglutaric acid (EDDG) and 2-hydroxypropylenediamine-N-N'-disuccinic acid (HPDDS) are also suitable.

Suitable chelating agents with two or more carboxylates or carboxylic acid groups include the acid or salt forms of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Chelants containing three carboxy groups include, in particular, the acids or salt forms of citrates, aconitrates and citraconates as well as succinate derivatives. Preferred carboxylate chelants are hydroxycarboxylates containing up to three carboxy groups per molecule, more particularly citrates and citric acids.

Chelating agents containing four carboxy groups include the salts and acid forms of oxydisuccinates, 1,1,2,2-ethane tetracarboxylates, 1,1,3,3-propane tetracarboxylates and 1,1,2,3-propane tetracarboxylates, sulfosuccinate derivatives.

Highly preferred it that at least one organo phosphonate or phosphonic acid and also at least one di- or tri-carboxylate or carboxylic acid is present. Highly preferred is that at least fumaric acid (or salt) and citric acid (or salt) and one or more phosphonates are present. Preferred salts are sodium salts.

Highly preferred is that the composition comprises, in addition to water, a plasticiser for the water-soluble pouch material, for example one of the plasticisers described above, for example glycerol. Such plasticisers can have the dual purpose of being a solvent for the other ingredients of the composition and a plasticiser for the pouch material.

(l) Hydrotropes

Another highly preferred optional ingredient is a hydrotrope. It has been found that the inclusion of a hydrotrope in the present pouch compositions can further improve dissolution. A hydrotrope is a substance with the ability to increase the solubility of certain slightly soluble organic compounds. A description of hydrotropes for use herein can be found in Surfactant Science, Vol. 67 "Liquid Detergents", 1997 in Chapter 2 entitled "Hydrotropy".

Preferably the compositions herein comprise from 0.01% to 15%, more preferably from 0.1% to 10%, even more preferably from 0.25% to 7%, even more preferably still from 0.5% to 5%, by weight of composition, of hydrotrope.

Preferred hydrotropes are selected from the group consisting of sodium cumene sulphonate, sodium xylene sulphonate, sodium naphthalene sulphonate, sodium p-toluene sulphonate, and mixtures thereof. Especially preferred is sodium cumene sulphonate. While the sodium form of the hydrotrope is preferred, the potassium, ammonium, alkanolammonium, and/or $C_2$-$C_4$ alkyl substituted ammonium forms can also be used.

Other Optional Ingredients

Other optional ingredients suitable for inclusion in the composition herein include colours, opacifiers, anti-oxidants, bactericides, neutralizing agents, buffering agents, phase regulants, tickeners and filler salts, with sodium sulfate being a preferred filler salt.

Use of the Unit Dose Products

The unit dose products of the present invention are used for cleaning and for softening of laundry. Typically, the unit dose product is added to the dispensing drawer, or alternatively to the drum, of an automatic washing machine. Preferably, the pouch dissolves or disintegrates in water to deliver the detergent ingredients to the washing cycle.

Preferably, the unit dose products comprises all of the detergent ingredients of fabric cleaning system and all of the fabric softening ingredients used in the fabric treatment application during the wash cycle. Although it may be preferred that some detergent ingredients are not included within the pouch and are added to the washing cycle separately. In addition, one or more fabric treatment compositions other than the compositions held by the pouch can be used during the laundering process, such that said composition is used as a pre-treatment, main-treatment, post-treatment or a combination thereof during such a laundering process.

The unit dose products of the present invention provide fabric treatment compositions suitable for low and high wash temperatures (e.g., 5° C. to below 40° C. for low temperatures and from 40° C. to 95° C. for high temperatures), low and high water levels (e.g., as in crease cycles for low water levels and as in wool cycles for high water levels), short and long washing times (e.g., 5 min. to below 50 min. for short washing times, and from 50 min. to 180 min. for long washing times) and the presence of small and large amounts of laundry (for example when the washing machine is "stuffed" with laundry).

Process for Preparing the Fabric Treatment Composition

The fabric treatment compositions used in the present invention can be prepared in any suitable manner and can, in general, involve any order of mixing or addition. However, there is a preferred way to make such compositions.

The first step involves the preparation of the fabric cleaning system by combining all fabric cleaning ingredients in any suitable manner. The second step involves the preparation of the fabric softening system by combining all fabric softening ingredients in any suitable manner. The third step involves the combination of the fabric softening system and of the fabric cleaning system. In case the fabric softening system comprises clay as fabric softening active, the fabric softening system is added to the fabric cleaning premix or vice versa as a premix comprising the clay and a solvent. In case the fabric softening system comprises a non-cationic silicone as fabric softening active, the fabric softening system can be added to the fabric cleaning premix or vice versa either as a premix comprising the silicone and a solvent or the silicone can be added without any solvent as pure component.

This process for preparing the fabric treatment composition of the present invention is preferably carried out using conventional high-shear mixing means. This ensures proper dispersion or dissolution of all ingredients throughout the final composition.

Liquid compositions, especially liquid detergent compositions in accordance with the invention preferably comprise a stabilizer, especially preferred being trihydroxystearin or hydrogenated castor oil, for example the type commercially available as Thixcin®. When a stabilizer is to be added to the present compositions, it is preferably introduced as a separate stabilizer premix with one or more of the adjuncts, or non-silicone components, of the composition. When such a stabilizer premix is used, it is preferably added into the composition after the non-cationic silicone polymer (if present) has already been introduced and dispersed in the composition.

The pouches can be made and filled in any conventional manner as disclosed in , for example, WO 02/08380 A1; WO 01/85 8981; WO 02/08 376 A1;WO 01/79 417 A1; and WO 01/83 661 A1.

Benefits

It has been found that the unit dose products of the present invention demonstrate very good cleaning performance and very good fabric softening performance. Additionally, it has been found that the unit dose products of the present invention demonstrate better solubility and/or lower residues formation.

Without being bound by theory, it is believed that the incompatibility of ingredient problem of previous liquid fabric detergent compositions has arisen due to an interaction of the anionic surfactant with a cationic fabric softening active. By utilizing a non-cationic fabric softening agent as suggested by the present invention, this interaction is reduced and/or eliminated in this invention so that the fabric treatment compositions of the present invention provide both a fabric cleaning benefit and a fabric softening benefit. The fabric cleaning benefits is provided through the cleaning system, e.g. through the anionic surfactant present and additionally also through additional further surfactants present, e.g. non-ionic, cationic, zwitterionic and amphoteric surfactants. The fabric softening benefit is provided through the fabric softening system comprising at least one non-cationic fabric softening active.

It should also be noted that the prior art incompatibility problem between any cationic species, e.g. from either the fabric cleaning system and/or from the fabric softening system, with the negatively charged surface of a polyvinyl-alcohol containing film has been solved. Without being bound by theory, it is believed that the interaction between these two groups of components has been reduced and/or eliminated by utilizing non-cationic fabric softening actives.

EXAMPLES

The following non-limiting examples are illustrative of the present invention. Percentages are by weight unless otherwise specified.

Example I

A piece of plastic is placed in a mould to act as a false bottom. The mould consists of a cylindrical shape and has a diameter of 45 mm and a depth of 25 mm. A 1 mm thick layer of rubber is present around the edges of the mould. The mould has some holes in the mould material to allow a vacuum to be applied. With the false bottom in place the depth of the mould is 12 mm. A piece of Monosol M-8630 film is placed on top of this mould and fixed in place. A vacuum is applied to pull the film into the mould and pull the film flush with the inner surface of the mould and the false bottom. 50 ml of the liquid fabric treatment composition is poured into the mould. Next, a second piece of Monosol M-8630 film is placed over the top of the mould with the liquid component and sealed to the first piece of film by applying an annular piece of flat metal of an inner diameter of 46 mm and heating that metal under moderate pressure onto the ring of rubber at the edge of the mould to heat-seal the two pieces of film together to form a compartment comprising the liquid component. The metal ring is typically heated to a temperature of from 135° C. to 150° C. and applied for up to 5 seconds.

Examples II-VI

Pouches are made by the process described in Example I and in enclosed volume of each pouch one of the following compositions is placed:

| | II % wt. | III wt % | IV % wt. | V % wt. | VI % wt. |
|---|---|---|---|---|---|
| Fabric cleaning system | | | | | |
| Dodecylbenzene sulphonic acid | 29.0 | 27.8 | 31.0 | 32.4 | 23.0 |
| $C_{13}$-$C_{15}$ alcohol, ethoxylated 7 times | 3.6 | 5.4 | 3.6 | — | 20.0 |
| $C_{12}$-$C_{18}$ alkyl fatty acid | 20.6 | 22.3 | 18.4 | 21.6 | 17.0 |
| Citric acid | 2.0 | — | 0.8 | 2.0 | — |
| Phosphonate chelant | 0.9 | — | 0.9 | 0.9 | 1.2 |
| Protease/amylase enzymes | 1.3 | 1.3 | 1.3 | 1.3 | 1.3 |
| Fabric whitening agent | 0.26 | — | 0.26 | 0.26 | — |
| Ethoxylated polyethyleneimine | — | 1.5 | 2.0 | — | 2.0 |
| Fabric softening system: | | | | | |
| Montmorillonite clay (1) | 6.1 | — | — | 4.3 | — |
| Polydimethylsiloxane (2) | — | 4.2 | 2.7 | 1.5 | 2.5 |
| Propandiol | 10.2 | 5.5 | 7.0 | 8.5 | 8.5 |
| Monoethanolamine | 5.0 | 3.8 | 2.4 | 4.2 | 5.0 |
| Solvents and minors: | | | | | |
| Propandiol | 6.0 | 14.0 | 11.0 | 9.0 | 7.5 |
| Water | 4.5 | 3.5 | 5.0 | 2.5 | 4.5 |
| Monoethanolamine | 7.9 | 8.0 | 10.0 | 10.0 | 5.0 |
| Trihydroxystearin | 0.2 | 0.15 | 0.1 | 0.15 | 0.15 |
| Perfumes, dyes, minors | to 100 | to 100 | to 100 | to 100 | to 100 |

(1): Gelwhite GP from Georgia Kaolin Co. Elizabeth, New Jersey;
(2): Polydimethylsiloxane with viscosities of 0.1 $m^2/s$ (100,000 centistokes), Silicone 200 Fluid ® series from Dow Corning;

The unit dose products of Example II to V all provide excellent fabric cleaning and fabric softening performance when added to the drum of an automatic washing machine wherein fabric are there and thereinafter laundered in conventional manner.

What is claimed is:

1. A unit dose fabric treatment product comprising a non-aqueous liquid fabric treatment composition comprising:

(A) a cleaning system comprising between about 20% and about 60%, by weight of the fabric treatment composition, of at least one anionic surfactant;

(B) from about 0.5% to about 10%, by weight of the fabric treatment composition, of a non-cationic fabric softening system comprising a fabric softening silicone;

(C) wherein the fabric softening silicone is added as a premix comprising the silicone and an organic solvent, or wherein the fabric softening silicone is added as pure compound without any organic solvent;

(D) wherein the percentage content of water in the fabric treatment composition is between about 3.5% and about 6% by weight of the fabric treatment composition; and (E) wherein said fabric treatment composition is contained within a pouch consisting of a single compartment water soluble pouch.

2. The unit dose fabric treatment product according to claim 1 wherein the cleaning system further comprises a surfactant selected from the group consisting of nonionic surfactants, cationic surfactants, zwitterionic surfactants, amphoteric surfactants; and mixtures thereof.

3. The unit dose fabric treatment product according to claim 2 wherein, in the cleaning system, at least 50% by weight of total surfactant comprises a non-alkoxylated anionic surfactant and less than 50% by weight of total surfactant comprises an alkoxylated surfactant.

4. The unit dose fabric treatment product according to claim 3 wherein, in the cleaning system, at least about 75% by weight of total surfactant comprises a non-alkoxylated anionic surfactant and less than about 25% by weight of total surfactant comprises an alkoxylated surfactant.

5. The unit dose fabric treatment product according to claim 1 wherein the solvent is a non-aqueous, organic solvent.

6. The unit dose fabric treatment product according to claim 5 wherein said solvent is selected from the group consisting of C1-C20 linear, branched, cyclic, saturated and/or unsaturated alcohols with one or more free hydroxy groups; ethers, polyethers, amines, alkanolamines, and mixtures thereof.

7. The unit dose fabric treatment product according to claim 6 wherein the non-aqueous solvent is selected from the group consisting of 1,2-propandiol, 1,3-propandiol, glycerol, ethylene glycol, diethyleneglycol, and mixtures thereof.

8. The unit dose fabric treatment product according to claim 1 wherein said fabric treatment composition further comprises a non-aqueous, organic solvent.

9. The unit dose fabric treatment product according to claim 8 wherein said solvent is selected from the group consisting of C1-C20 linear, branched, cyclic, saturated and/or unsaturated alcohols with one or more free hydroxy groups, ethers, polyethers, amines, alkanolamines, and mixtures thereof.

10. The unit dose fabric treatment product according to claim 9 wherein the non-aqueous solvent is selected from the group consisting of 1,2-propandiol, 1,3-propandiol, glycerol, ethylene glycol, diethyleneglycol, and mixtures thereof.

11. The unit dose fabric treatment product according to claim 8 wherein the non-aqueous solvent is present at levels of from about 0.1% to about 90% by weight of the fabric treatment composition.

12. The unit dose fabric treatment product according to claim 1 wherein the fabric treatment composition further comprises at least one fatty acid or salt thereof or mixtures thereof at levels of from about 2% to about 40% by weight of the fabric treatment composition.

13. The unit dose fabric treatment product according to claim 1 wherein the fabric treatment composition further comprises a stabilizer.

14. The unit dose fabric treatment product according to claim 13 wherein the stabilizer is selected from the group consisting of trihydroxystearins, hydrogenated oils, derivatives thereof and mixtures thereof.

15. The unit dose fabric treatment product according to claim 1 wherein the pouch comprises a polymer, and/or a co-polymer, and/or a ter-polymer based on polyvinyl alcohol (PVA), polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides preferably starch, gelatine, xanthan, carragum and other natural gums; and mixtures thereof.

16. The method of producing a unit dose fabric treatment product according to claim 1 the method comprising the steps of separately preparing the fabric cleaning system and the fabric softening system, and thereinafter combining the systems.

17. A method of imparting fabric-cleaning and fabric-softening benefits by single compartment water-soluble pouches to treat fabric laundered by using a unit dose fabric treatment product according to claim 1.

18. A unit dose fabric treatment product comprising a non-aqueous liquid fabric treatment composition comprising:

(A) a cleaning system comprising more than 5%, by weight of the fabric treatment composition, of at least one anionic surfactant;

(B) a non-cationic fabric softening system consisting of at least one non-cationic fabric softening active comprising a fabric softening silicone, (C) wherein the fabric softening silicone is added as a premix comprising the silicone and a solvent, or wherein the fabric softening silicone is added as pure compound without any solvent; and (D) wherein said fabric treatment composition is contained within a pouch consisting of a single compartment water soluble pouch.

19. The unit dose fabric treatment product according to claim 18 wherein, in the cleaning system, the surfactant is present at levels of between about 10% and about 80% by weight of the fabric treatment composition.

20. The unit dose fabric treatment product according to claim 19 wherein, in the cleaning system, the surfactant is present at levels of between about 20% and about 60% by weight of the fabric treatment composition.

21. The unit dose fabric treatment product according to claim 18 wherein, in the fabric softening system, the fabric softening active is present at levels of between about 0.0 1% and about 20% by weight of the fabric treatment composition.

22. The unit dose fabric treatment product according to claim 21 wherein, in the fabric softening system, the fabric softening active is present at levels of between about 0.5% and about 10% by weight of the fabric treatment composition.

23. The unit dose fabric treatment product according to claim 18 wherein the percentage content of water in the fabric treatment composition is below about 15% by weight of the fabric treatment composition.

24. The unit dose fabric treatment product according to claim 1, wherein said non-cationic fabric softening system further comprises a fabric softening clays; wherein the fabric softening clay is added as a premix comprising the clay and an organic solvent.

* * * * *

UNITED STATES PATENT AND TRADEMARK OFFICE

CERTIFICATE OF CORRECTION

PATENT NO. : 7,479,475 B2
APPLICATION NO. : 10/742555
DATED : January 20, 2009
INVENTOR(S) : Francesco de Buzzaccarini et al.

It is certified that error appears in the above-identified patent and that said Letters Patent is hereby corrected as shown below:

Column 10

Line 36, delete “10” and insert -- 100 --.

Column 14

Line 59, delete “arc” and insert -- are --.

Column 15

Line 49, after “thereof” insert -- . --.

Line 53, delete “thereon” and insert -- thereof --.

Line 55, delete “diethylerieglycol,” and insert -- diethyleneglycol, --.

Column 16

Line 28, after “thereof” insert -- . --.

Column 18

Line 64, delete “anin-situ” and insert -- an in-situ --.

Column 20

Line 20, delete “(R)” and insert -- (g) --.

Line 43, delete “polyarmine” and insert -- polyamine --.

UNITED STATES PATENT AND TRADEMARK OFFICE

CERTIFICATE OF CORRECTION

PATENT NO. : 7,479,475 B2
APPLICATION NO. : 10/742555
DATED : January 20, 2009
INVENTOR(S) : Francesco de Buzzaccarini et al.

It is certified that error appears in the above-identified patent and that said Letters Patent is hereby corrected as shown below:

Column 24

Line 12, delete "01/85 8981;" and insert -- 01/85898 A1; --.

Signed and Sealed this

Twenty-fifth Day of August, 2009

David J. Kappos

David J. Kappos
*Director of the United States Patent and Trademark Office*